US011242490B2

(12) United States Patent
Das et al.

(10) Patent No.: US 11,242,490 B2
(45) Date of Patent: Feb. 8, 2022

(54) METHOD FOR PRODUCING METALLURGICAL COKE FROM NON-COKING COAL

(71) Applicants: TATA STEEL LIMITED, Jharkhand (IN); THE UNIVERSITY OF NOTTINGHAM, Nottingham (GB)

(72) Inventors: Bidyut Das, Jamshedpur (IN); Sanjay Chandra, Jamshedpur (IN); Atanu Ranjan Pal, Jamshedpur (IN); Pratik Swarup Dash, Jamshedpur (IN); Munish Sudan, Jamshedpur (IN); Eleanor Binner, Nottingham (GB); Christopher Dodds, Nottingham (GB); Edward Henry Lester, Nottingham (GB); Orla Williams, Nottingham (GB); Samuel Kingman, Nottingham (GB)

(73) Assignees: The University of Nottingham, Nottinghamshire (GB); Tata Steel Limited, Jharkhand (IN)

( * ) Notice: Subject to any disclaimer, the term of this patent is extended or adjusted under 35 U.S.C. 154(b) by 0 days.

(21) Appl. No.: 16/966,954

(22) PCT Filed: Feb. 6, 2019

(86) PCT No.: PCT/IB2019/050936

§ 371 (c)(1),
(2) Date: Aug. 3, 2020

(87) PCT Pub. No.: WO2019/155367

PCT Pub. Date: Aug. 15, 2019

(65) Prior Publication Data

US 2021/0040393 A1 Feb. 11, 2021

(30) Foreign Application Priority Data

Feb. 6, 2018 (IN) ..... 201831004462

(51) Int. Cl.
*C10B 53/08* (2006.01)
*C10B 19/00* (2006.01)

(52) U.S. Cl.
CPC ..... *C10B 53/08* (2013.01); *C10B 19/00* (2013.01)

(58) Field of Classification Search
CPC ..... C10B 53/08; C10B 19/00
See application file for complete search history.

(56) References Cited

U.S. PATENT DOCUMENTS 2,353,753 A * 7/1944 Otto ..... C10B 57/04 201/6
3,444,046 A * 5/1969 Harlow ..... C10L 5/04 201/6

(Continued)

FOREIGN PATENT DOCUMENTS

JP H07-166166 6/1995
WO WO-2009/047682 4/2009

OTHER PUBLICATIONS

International Search Report and Written Opinion for PCT Application No. PCT/IB2019/050936, dated Jul. 3, 2019.

*Primary Examiner* — Jonathan Miller
(74) *Attorney, Agent, or Firm* — Foley & Lardner LLP

(57) ABSTRACT

The present disclosure relates to a method for producing metallurgical coke from non-coking coal. The method comprising, densifying, the non-coking coal to form pellets. The densified pellets will be placed in a microwave oven within plurality of bricks and are subjected for pyrolysis. For carrying our pyrolysis, the pellets are carried out by heating, the pellets in the microwave oven at a predetermined temperature under an inert atmosphere at atmospheric pressure, and then the pellets are cooled in the microwave oven under the inert atmosphere. This process coverts non-coking coal (Continued)

to the metallurgical coke in a quicker time, and without use of any susceptors.

12 Claims, 3 Drawing Sheets

(56) References Cited

U.S. PATENT DOCUMENTS 3,546,076 A * 12/1970 Muller ..... C10B 53/08 201/6
4,141,793 A * 2/1979 Aoki ..... C10B 7/00 110/247
4,234,386 A * 11/1980 Stirling ..... C10B 53/08 201/44
4,257,848 A * 3/1981 Brayton ..... C10B 57/04 100/94
4,282,066 A * 8/1981 Wagener ..... C10B 19/00 201/6
4,419,186 A * 12/1983 Wienert ..... C21B 5/007 201/6
5,423,951 A * 6/1995 Wienert ..... C22B 1/245 201/20
6,033,528 A * 3/2000 Sakawa ..... C10B 57/04 201/1
7,497,928 B2 * 3/2009 Clark ..... C10B 53/08 201/6
8,585,786 B2 * 11/2013 Drozd ..... F23K 1/00 44/553
8,585,788 B2 * 11/2013 Drozd ..... C10L 5/361 44/620
2005/0155281 A1 7/2005 Clark
2013/0255142 A1 10/2013 Dohi et al.
2015/0068113 A1 * 3/2015 Conner ..... C10L 1/00 44/606

* cited by examiner

4

METHOD FOR PRODUCING METALLURGICAL COKE FROM NON-COKING COAL

CROSS-REFERENCE TO RELATED PATENT APPLICATIONS

The present application is a U.S. national stage of PCT Application No. PCT/IB2019/050936, filed on Feb. 6, 2019, which claims priority to and the benefit of Indian Application No. 201831004462, filed on Feb. 6, 2018, the contents of which are incorporated herein by reference.

TECHNICAL FIELD

The present disclosure generally relates to fossil fuels. Particularly, but not exclusively, the present disclosure relates to producing coke from coal. Further, embodiments of the present disclosure disclose a method for producing metallurgical coke from non-coking coal.

BACKGROUND OF THE DISCLOSURE

Blast furnaces or metallurgical furnaces are widely used in various metallurgical process. One such widely used metallurgical process in blast furnace is smelting. Smelting in blast furnaces involves usage of coke or metallurgical coke for extracting metal from its ore. Coke in blast furnaces provides heat for endothermic requirements of chemical reactions. Coke also aids in melting of slag and metal whilst acting as a reducing agent. Coke also provides permeable support to the matrix which is necessary for slag and metal to pass through the hearth, thus aiding in the passage of gas upwards towards the stack of the blast furnace.

Conventionally, metallurgical coke was produced in ovens which may use external heat sources to bake the coke. The coking factor of such metallurgical coke aided in elemental changes when exposed to heating. Specifically, the coal which was used to produce metallurgical coke was categorized into a coking-coal and a non-coking coal. Usually, coking coal has the property to soften and become fluid when heated and then re-solidify upon heating. Thus, coals which did not have the above-mentioned properties were termed as non-coking coals. However, coking coals are a scarce commodity and hence difficult to obtain and convert to metallurgical coke. Moreover, coke producers on the other hand have an abundance of non-coking coal. Due to their high ash content, such non-coking coals may not be readily suitable for use in metallurgical process in the blast furnaces.

Over the years, metallurgical coke was commercially produced for use in blast furnaces. Such metallurgical coke was obtained by exposing the coking or non-coking coals to microwave radiation at increased core temperatures. Since coal does not contain graphene lattices of large sizes, they are transparent to microwaves. Due to this, delocalized $\pi$ electrons cannot move freely and couple with the electromagnetic field of the microwaves. Hence, coke producers use higher dielectric constant coal matrix such as moisture and pyrite to increase reaction with microwaves. This was possible only with the addition of receptor substances to the coal matrix to improve pyrolysis.

With on-going efforts for converting non-coking coal to metallurgical coke, many methods have been proposed and employed in industries. Such methods may include, use of susceptors for coking the coal in the microwave oven. However, these susceptors are used to increase absorption of the microwave radiation and thereby increase operating temperatures of the susceptors in excess of 1100° C. which aids in producing metallurgical coke.

Similarly, in some of the coke producing processes, use of low rank coal [i.e. high volatile bituminous coal] to produce metallurgical coke was carried out. However, production of such metallurgical coke involved heating low rank coal to long durations in excess of an hour's time while using microwave energy power in the range excess to 8 kW at 2.45 GHz.

Other metallurgical coke production processes involve subjecting of the non-coking coal samples to rapid heating with microwaves at a rate of about 30° C./min to about 35° C./min. Along with rapid heating, the non-coking coal samples were subjected to loads in excess of 600 KN/m$^2$ for about 30 mins. Again, this sample was subjected to carbonization in a furnace to about 900° C. at a rate of 5° C./min and held at this temperature for about 2 hours. Such process involved plurality of process steps to obtain desired properties in the metallurgical coke so produced.

In few other conventional processes, commercially produced metallurgical coke required heating of the coal samples to about 70 mins to about 80 mins which demanded huge power requirements in the range of 13,600 kW/t which was uneconomical and a costly process.

Thus, some of the conventional coke producing process utilizes susceptors for improving microwave absorption and in several other cases, use of non-coking coal to produce metallurgical coke involved excess process time and energy consumption which is not economical.

The present disclosure is directed to overcome one or more limitations stated above, and any other limitations associated with the prior arts.

SUMMARY OF THE DISCLOSURE

One or more drawbacks of conventional methods of producing metallurgical coke from non-coking coals are overcome, and additional advantages are provided through a method as claimed in the present disclosure. Additional features and advantages are realized through the technicalities of the present disclosure. Other embodiments and aspects of the disclosure are described in detail herein and are considered to be a part of the claimed disclosure.

In one non-limiting embodiment of the present disclosure, a method for producing metallurgical coke from non-coking coal is disclosed. The method comprises densifying, the non-coking coal to form pellets. Then, the pellets are placed in a microwave oven within plurality of bricks followed by heating the pellets in a microwave oven at a predetermined temperature under an inert atmosphere at atmospheric pressure, wherein the pellets undergo pyrolysis during the heating. Cooling the pellets in the microwave oven under the inert atmosphere, to convert the pellets of the non-coking coal to the metallurgical coke.

In an embodiment, the heating of the pellets in the microwave oven is carried out without susceptors.

In an embodiment, densifying of the non-coking coal, includes crushing the non-coking coal to form crushed non-coking coal and compacting the crushed non-coking coal to form the pellets.

In an embodiment, densifying the non-coking coal includes crushing the non-coking coal and compacting the crushed non-coking coal to form the pellets. Further, the crushing of the non-coking coal is carried out in a hammer mill, a pulveriser mill, or any other mill such that, the crushed non-coking coal has about 80% to about 90% fineness.

In an embodiment, the compacting of the crushed non-coking coal is carried out in a press, such that compacted density of the pellets are in the range of about 1100 kg/m$^3$ to about 1150 kg/m$^3$.

In an embodiment, a binder is used in compacting of the crushed non-coking coal to form the pellets.

In an embodiment, the inert atmosphere is created by purging inert gas into the microwave oven.

In an embodiment, the inert atmosphere is created by purging inert gas into the microwave oven. The inert gas is purged into the microwave oven before heating of the pellets and during heating of the pellets, at a flow rate ranging from about 60 litres/minute to about 90 litres/minute for a time period ranging from about 3 minutes to about 8 minutes.

In an embodiment, the pellets are subjected to cooling in the microwave oven under the inert atmosphere at a rate of about 5 l/min to about 20 l/min.

In an embodiment, the heating is carried out at a microwave power intensity in the range of about 2 kW to about 8 kW for a time period ranging from about 10 minutes to about 40 minutes.

In an embodiment, the predetermined temperature ranges from about 900° C. to about 1100° C., increasing at a rate of about 40° C. to 60° C. per minute.

In an embodiment, the density of the metallurgical coke produced by the method is in the range of about 380 kg/m$^3$ to about 440 kg/m$^3$.

It is to be understood that the aspects and embodiments of the disclosure described above may be used in any combination with each other. Several of the aspects and embodiments may be combined together to form a further embodiment of the disclosure.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING DRAWINGS

The novel features and characteristics of the disclosure are set forth in the appended description. The disclosure itself, however, as well as a preferred mode of use, further objectives and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which.

Figure 1:
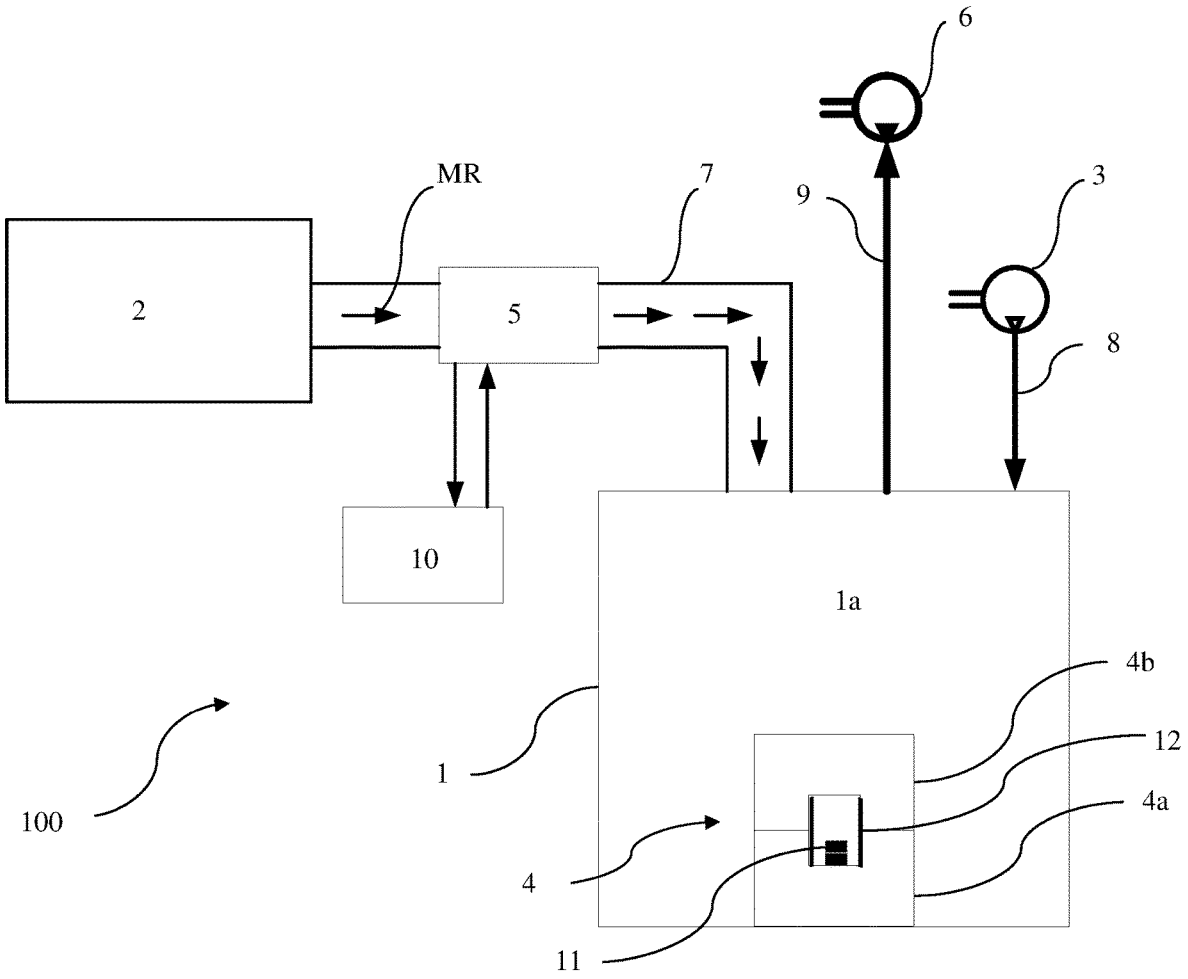
FIG. 1 illustrates a schematic view of a system for producing metallurgical coke from non-coking coal, in accordance with an embodiment of the present disclosure.

The figures depict embodiments of the disclosure for purposes of illustration only. One skilled in the art will readily recognize from the following description that alternative embodiments of the structures and methods illustrated herein may be employed without departing from the principles of the disclosure described herein.

DETAILED DESCRIPTION OF THE DISCLOSURE

The foregoing has broadly outlined the features and technical advantages of the present disclosure in order that the detailed description of the disclosure that follows may be better understood. Additional features and advantages of the disclosure will be described hereinafter which form the subject of the description of the disclosure. It should also be realized by those skilled in the art that such equivalent methods do not depart from the scope of the disclosure.

The novel features which are believed to be characteristic of the disclosure, as to method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described in detail below. It should be understood, however, that it is not intended to limit the disclosure to the particular forms disclosed, but on the contrary, the disclosure is to cover all modifications, equivalents, and alternative falling within the spirit and the scope of the disclosure.

The terms "comprises", "comprising", or any other variations thereof, are intended to cover a non-exclusive inclusion, such that a method that comprises a list of acts does not include only those acts but may include other acts not expressly listed or inherent to such method. In other words, one or more acts in a method proceeded by "comprises . . . a" does not, without more constraints, preclude the existence of other acts or additional acts in the method.

Embodiments of the present disclosure relates to a method of producing metallurgical coke from non-coking coal. The non-coking coal as known in the art would usually contain high ash content, and hence may not be suitable for use in metallurgical processes like smelting. However, the non-coking coals are widely available for lower cost when compared to coking coals. Hence, conventionally, various techniques or methods have been employed to produce metallurgical coke from low-grade non-coking coals. One such common method was subjecting non-coking coal to high temperatures either by using microwave radiations or furnaces. Subjecting such non-coking coals to high temperatures altered the elemental structure leading to the formation of microstructural changes and thereby forming metallurgical coke. However, usage of microwave radiation in producing metallurgical coke from non-coking coal is a well-known process. Production of such metallurgical coke required usage of susceptors to increase microwave radiation absorption to induce matrix changes in the non-coking coal. Also, in some conventional processes discussed in the background section, use of such susceptors increased energy consumption to produce heat for longer durations to obtain metallurgical coke, which is undesired.

The method for producing metallurgical coke according to embodiments of the present disclosure do not use susceptors for treating the non-coking coal. The method according to embodiments of the disclosure, involves densifying the non-coking coal as a first step in order to densify the elemental composition of the non-coking coal. Such densification aids in absorption of microwave radiation. Also, such densification prevents usage of microwave susceptors to aid in absorption of microwave radiation to increase the temperature of the non-coking coal. The densified non-coking coal may be then subjected to pyrolysis in the microwave oven which converts the non-coking coal to metallurgical coke in less lead time and minimum use of power.

In the following detailed description of the embodiments of the disclosure, reference is made to the accompanying drawings that form a part hereof, and in which are shown by way of illustration specific embodiments in which the disclosure may be practiced. These embodiments are described in sufficient detail to enable those skilled in the art to practice the disclosure, and it is to be understood that other embodiments may be utilized and that changes may be made without departing from the scope of the present disclosure. The following description is, therefore, not to be taken in a limiting sense.

The present disclosure relates to a method for producing metallurgical coke from non-coking coal. The non-coking coal for producing metallurgical coke is selected based on the requirement for usage in the blast furnaces for smelting ores. The non-coking coal used in the method of present disclosure has high-ash content with a low calorific value. The non-coking coals are further subjected to selection tests such as crucible swelling number (CSN) and caking properties. In an embodiment, the crucible swelling number (CSN) for the non-coking coal may be in the range of 1 to 4. In an embodiment, the caking properties of the non-coking coal upon heating, softens and forms plastic mass which swells and solidifies into a porous solid.

The selected non-coking coals may be subjected to crushing or grinding, wherein the non-coking coals are reduced in size to the required dimension. In an exemplary embodiment, crushing of the non-coking coal may be carried out in a mill until the non-coking coal is in the powdered form. As an example and for the interests of testing, the crushed non-coking coal were reduced to granules not exceeding 3.50 mm. The powdered non-coking coal was next subjected to a densifying process. The densifying process involves compacting the powdered non-coking coal in a compactor.

In an embodiment, compacting of the non-coking coal aids in densifying the elemental composition of the non-coking coal thereby increasing the density of the non-coking coal. This densification results in absorption of the microwave radiation (MR) impinged on the non-coking coal and prevents usage of susceptors or addition of receptor substances. Upon compacting, the non-coking coal is formed into pellets (11) herein referred to as non-coking coal pellets (11) suitable for testing purposes. For test requirements, the non-coking coal pellets (11) may be formed by compacting the powdered non-coking coal. As an example, the non-coking coal pellets (11) may be compacted to a dimension ranging from about 30 mm to about 50 mm wherein, the non-coking coal is ground to about 80% to about 90% fineness. Additionally, during compaction of the ground non-coking coal, a binder which serves the purpose of binding the ground non-coking coal is used for forming the non-coking coal pellets (11).

In an embodiment, the binder used in producing non-coking pellets (11) is, but not limited to water.

In an embodiment, crushing of the non-coking coal is carried out in a hammer mill, a pulveriser mill, or any other mill that serves the purpose.

In an embodiment and for test requirements, the compacted non-coking coal pellets (11) have a density in the range of about 1100 $kg/m^3$ to about 1180 $kg/m^3$.

In an embodiment, the ground non-coking coal are compacted in a compactor, a pellet press or any other compactor that serves the purpose.

The non-coking coal pellets (11) referred in this description are compacted into pellets for laboratory testing, however, these pellets may be of any shape and size based on the requirement.

FIG. 1 is an exemplary embodiment of the present disclosure illustrating a test system (100), for producing the metallurgical coke from non-coking coal. The test system (100) includes a microwave oven (1) having a chamber (1*a*). The chamber (1*a*) provided in the microwave oven (1) may be used to place the non-coking coal pellets (11). The microwave oven (1) may be connected to a microwave generator (2) such that microwave radiation (MR) is transmitted from the microwave generator (2) and into the chamber (1*a*) of the microwave oven (1). At least one waveguide (7) may be provided between the microwave oven (1) and the microwave generator (2). The at least one waveguide (7) receives and transmits the microwave radiation (MR) generated from the microwave generator (2) into the microwave oven (1). A plurality of firebricks (4) may be used for holding the non-coking coal pellets (11). In an embodiment, the plurality of firebricks (4) may include a base firebrick (4*b*) and a cover firebrick (4*a*). The base firebrick (4*b*) is defined with a hole to hold the non-coking coal pellets (11). Similarly, the cover firebrick (4*a*) may be also defined with the hole which matches the hole present in the base firebrick (4*b*). Additionally, the holes defined on the base firebrick (4*b*) and the cover firebrick (4*a*) are smeared with grout (12) which is thermally resistant to trap the heat generated for efficient pyrolysis.

The test system (100) further comprises of at least one tuner device (5) connected to the at least one waveguide (7). The at least one tuner device (5) tunes the amount of microwave radiation (MR) entering the microwave oven (1). The at least one tuner device (5) may be controlled by a control unit (10) associated with the system. Further, at least one purging system (3) is connected to the microwave oven (1), wherein the at least one purging system (3) delivers inert gases into the chamber (1*a*) of the microwave oven (1). An extractor unit (6) is also disposed in fluid communication with the chamber (1*a*) which extracts atmospheric air from the chamber (1*a*) during pyrolysis process of the non-coking coal pellets (11) to metallurgical coke. In an embodiment, the extractor unit (6) may be connected to the microwave oven (1) by at least one outlet conduit (9) for extracting atmospheric air and gases formed due to pyrolysis.

In an embodiment the microwave generator (2) is at least one of an industrial grade 30 microwave generator (2) used in generating large volumes of microwaves with a microwave power intensity in the range of about 2 kW to about 8 kW.

In an embodiment, the plurality of firebricks (4) may be selected from an insulating firebrick of grade 30 (ASTM C155-97 Classification C 30). The plurality of firebricks used in the test system (100) is considered transparent to microwave radiation (MR).

In an embodiment, the microwave oven (1) is at least one of an industrial grade 30 microwave oven (1) lined with refractory bricks [not shown in the figures] to thermally insulate the heat generated within the microwave oven (1). The microwave oven (1) used in the test system (100) is limited to a lab scale multimode system wherein the chamber (1*a*) of the microwave experiences high and low electric fields.

In an embodiment, the at least one tuner device (5) is at least one of a computer controlled microwave tuner. The at least one tuner device (5) is programmed to transmit frequency in the range of about 2000 MHz about 4000 MHz.

In an embodiment, the at least one purging system (3) is a nitrogen gas purging system. Nitrogen gas may be purged into the chamber (1*a*) of the microwave oven (1) to form an inert atmosphere. Purging of the nitrogen gas into the chamber (1*a*) of the microwave oven (1) may be carried out at a flow rate ranging from about 60 litres/minute to about 90 litres/minute. During operation of the test system (100), the nitrogen gas is purged into the chamber (1*a*) before subjecting the non-coking coal pellets (11) to microwave radiation (MR), during exposure of non-coking coal pellets (11) to microwave radiation (MR) and after exposure to microwave radiation (MR). Moreover, for the test requirements, purging of nitrogen gas into the chamber (1*a*) of the microwave oven (1) has a time interval ranging from about 3 minutes to about 8 minutes.

In an embodiment, the nitrogen gas may be purged into the microwave oven (1) by aid of at least one inlet conduit (8).

In an embodiment, the inert atmosphere, prevents oxidation of metallurgical coke before, during and after exposure to microwave radiation (MR).

In an embodiment, the grout (12) used for smearing the defined holes is at least one of fluid concrete used to thermally insulate the defined holes where the non-coking coal pellets (11) are placed.

Preparation of Test System

The compacted non-coking coal which are formed into non-coking coal pellets (11) may be placed within the chamber (1*a*) of the microwave oven (1). The non-coking coal pellets (11) are placed in holes defined in the plurality of firebricks. After placing the non-coking coal pellets, (11) the chamber (1*a*) of the microwave oven (1) may be drained of any atmospheric air by the help of the extractor unit (6). Then, the chamber (1*a*) of the microwave oven (1) is purged with nitrogen gas to create an inert atmosphere.

Non-Coking Coal Subjected to Microwave Radiation in the Test System

The microwave radiation (MR) generated from the microwave generator (2) is impinged on the plurality of firebricks (4). The extractor unit (6) continuously extracts the combusted gases during microwave radiation (MR) impingement on the non-coking coal pellets (11). Simultaneously the at least one purging system (3) purges nitrogen gas into the chamber (1*a*) of the microwave oven (1) thereby maintaining the inert atmosphere. When the microwave radiation (MR) impinges on the non-coking coal pellets (11), pyrolysis of the non-coking coal pellets (11) occurs wherein the microwave energy is absorbed by the non-coking coal pellets (11). The control unit (10) continuously monitors the energy absorbed and the load of microwave radiation (MR). The non-coking coal pellets (11) are exposed to microwave radiation (MR) for a predetermined time interval.

As per test requirements, the temperature within the chamber (1*a*) of the microwave oven (1) was maintained in the range of about 900° C. to about 1100° C., wherein the temperature is gradually increased in the range of about 40° C. to about 60° C. Additionally, the power intensity of the microwave oven (1) is in the range of about 2 kW to about 8 kW for a time period ranging from about 10 minutes to about 40 minutes.

The non-coking coal pellets (11) upon exposure to microwave radiation (MR) imparts changes in coke carbon forms resulting in metallurgical coke.

Lastly, the exposed non-coking coal pellets (11) which are now metallurgical coke are cooled in the chamber (1*a*) in the inert atmosphere for a predetermined time period. This cooling of the metallurgical coke prevents oxidation of the metallurgical coke.

Post Processes

Once the metallurgical coke is cooled, the mass is removed, weighed and measured followed by proximate and petrographic assessment of the non-coking coal. The proximate analysis was carried out as per respective ASTM standards.

TABLE 1 depicts proximate and petrographic assessment of non-coking coal:

| | |
|---|---|
| PROXIMATE ANALYSIS | |
| Moisture (%) | 3.3 |
| Fixed Carbon (%) | 41.7 |
| DAF Volatiles (%) | 35.5 |
| Dry Ash | 22.8 |
| ULTIMATE ANALYSIS | |
| C (% daf) | 66.62 |
| H (% daf) | 5.20 |
| N (% daf) | 1.35 |
| S (% daf) | 1.09 |
| O (% daf) | 25.74 |
| MACERAL ANALYSIS | |
| Vitrinite (%) | 37.6 |
| Liptinite (%) | 9.6 |
| Semi-Fusinite (%) | 32.4 |
| Fusinite (%) | 20.4 |
| VITRINITE REFLECTANCE | |
| Average (%) | 0.46 |
| Minimum (%) | 0.33 |
| Maximum (%) | 1.11 |
| St. Dev. | 0.157 |

TABLE 2 illustrates density of non-coking coal before and after exposure to microwave radiation (MR).

| Conditions | | Before | During | | After |
|---|---|---|---|---|---|
| | | | Volatile Release | Volatile Release | |
| Power (kW) | Time (Minute) | Density kg/m3 | Start Time (Min) | End Time (Min) | Density kg/m3 |
| 6 | 10 | 1169 | 0.3 | 8.2 | 399 |
| 6 | 15 | 1174 | 0.3 | 8.3 | 576 |
| 6 | 20 | 1179 | 0.5 | 8.5 | 420 |

From the above table 2, it is evident that the density of the non-coking coal pellets (11) when compacted before subjecting to microwave radiation (MR) is in the range of about 1100 kg/m$^3$ to about 1180 kg/m$^3$. Also, from the above table 2, the volatile composition release from the non-coking coal pellets (11) are in the start range of about 0.3 min to about 0.6 min. The volatile composition release from the non-coking coal pellets (11) are in the end range of about 8.0 min to about 9.0 min. As observed, upon increasing exposure to microwave radiation (MR) the density of the non-coking coal reduces to about 380 kg/m$^3$ to about 440 kg/m$^3$ resulting in metallurgical coke.

TABLE 3 illustrates texture of the metallurgical coke produced from non-coking coal for varying time intervals.

| Coke Carbon Forms | 6 kW 10 Minutes | 6 kW 15 Minutes | 6 kW 20 minutes |
|---|---|---|---|
| Isotropic | 10.4 | 6.3 | 7.2 |
| Incipient | 0.4 | 0.4 | 0.4 |
| Circular | 0.4 | 2.4 | 3.2 |
| Lenticular | 0 | 0.0 | 0 |
| Ribbon | 0 | 0.0 | 0 |
| Filler | 88.8 | 91.0 | 89.2 |
| Total | 100.0 | 100.0 | 100.0 |

From the above table 3, it is evident that the increased exposure to microwave radiation (MR) increased the volume percentage of the circular coke texture. The isotropic material changes its texture to desired circular coke texture. This circular coke texture is essential in gasification of the coke inside blast furnace and controls the reactivity and post-reaction strength of coke.

Figure 2:
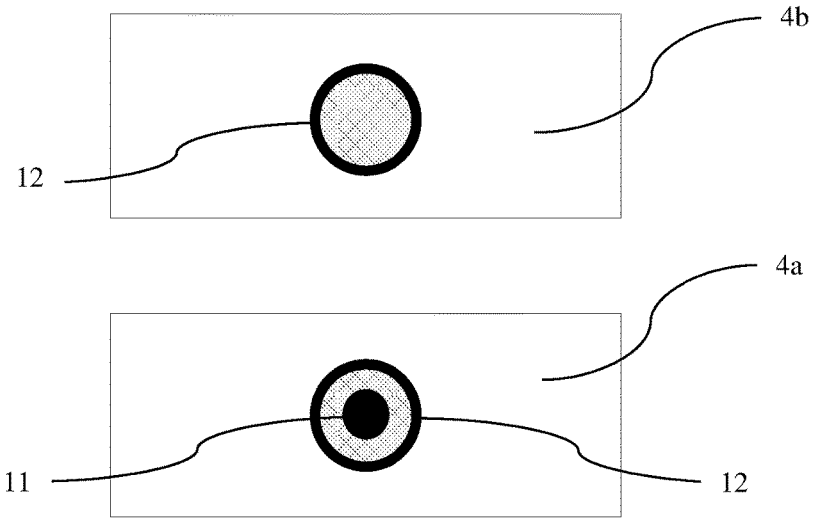
FIG. 2 illustrates a schematic view of firebricks for placing non-coking coal pellets, in accordance with an embodiment of the present disclosure.

FIG. 2 illustrates the plurality of firebricks (4) comprising of the base firebrick (4*b*) defined with hole wherein the hole is smeared with grout (12) for thermal insulation. Similarly, the cover firebrick (4*a*) is also defined with a hole matching the hole of the base firebrick (4*b*) and is smeared with grout (12) for thermal insulation. Upon placement of the non-coking coal pellets (11) in the base firebrick (4*b*), the cover firebrick (4*a*) is covered over the base firebrick (4*b*).

For lab testing requirements, the diameter of the defined hole is in the range of 30 mm to about 40 mm and the crucible swelling number (CSN) of the non-coking coal is in the range of 1 to 4.

Figure 3:
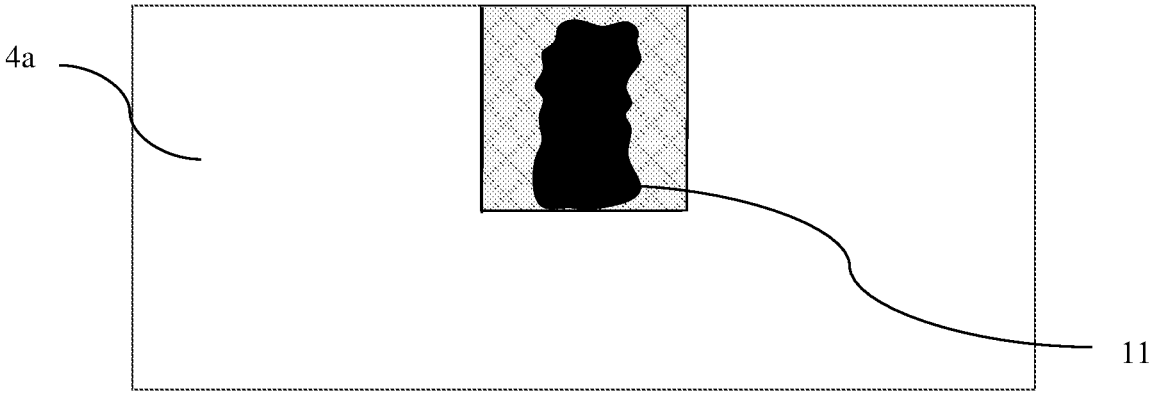
FIG. 3 illustrates the plurality of firebricks of FIG. 2 showing pyrolysis of the non-coking coal pellets after treatment in the microwave oven for a first predefined time interval, in accordance with an embodiment of the present disclosure.

FIG. 3 illustrates the plurality of firebricks (4) exposed to microwave radiation (MR) with a rated microwave poser intensity of 6 kW and an exposure time of about 15 minutes. The plurality of firebricks (4) which are effectively transparent to the microwave radiation (MR) allows passage of the microwave radiation (MR) to be absorbed by the non-coking coal pellets (11). As shown in FIG. 3, non-coking coal pellets (11) has undergone pyrolysis during the heating and cooling process in the chamber (1*a*) of the microwave oven (1). This shows that, the non-coking coal pellets (11) are converted to metallurgical coke within 15 minutes, and without use of any additional components like susceptors.

Figure 4:
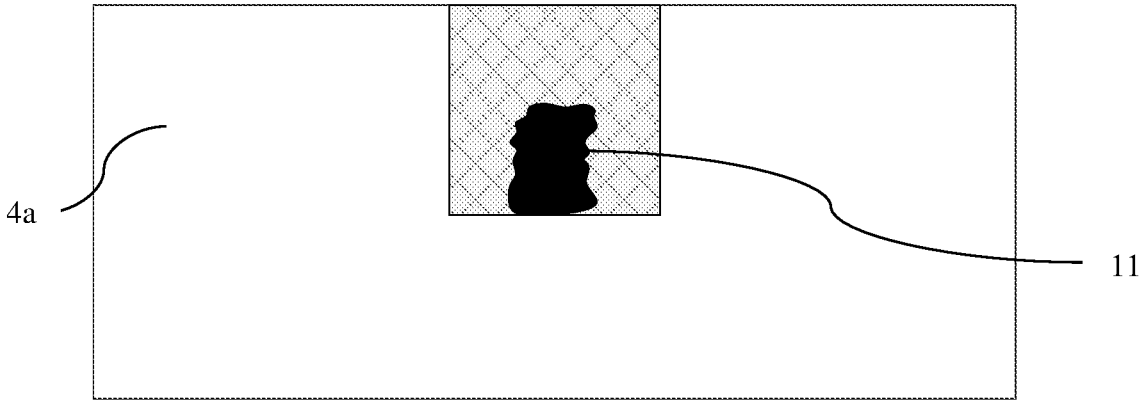
FIG. 4 illustrates the plurality of firebricks of FIG. 2 showing pyrolysis of the non-coking coal pellets after treatment in the microwave oven for a second predefined time interval, in accordance with an embodiment of the present disclosure.

FIG. 4 illustrates the plurality of firebricks (4) exposed to microwave radiation (MR) with a rated microwave power intensity of 6 kW and an exposure time of about 20 minutes. The non-coking coal pellets (11) subjected to increased exposure time, increases the circular texture formation on the surface of the metallurgical coke. The grout (12) smeared to the plurality of firebricks (4) retains the heat generated when the microwave oven (1) is in operation.

Figure 5:
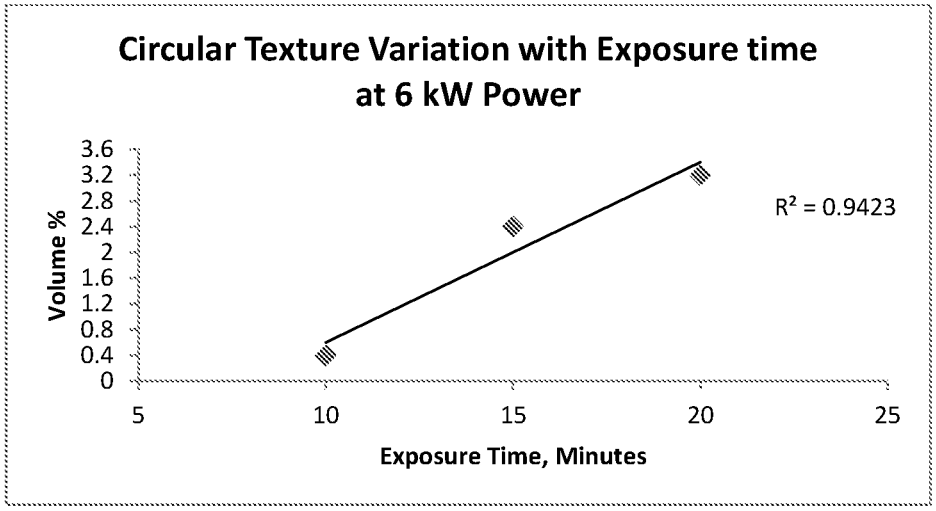
FIG. 5 illustrates a graph of circular texture formation on the metallurgical coke with variation in exposure time in the microwave oven, in accordance with an embodiment of the present disclosure.

FIG. 5 illustrates the graph plotted with volume of circular texture variation versus exposure time while converting non-coking coal to the metallurgical coke. Based on the test results, the non-coking coal pellets (11) are subjected to microwave radiation (MR) exposure in the range of 10 mins, 15 mins and 20 mins. It was inferred from the test results that, based on increased exposure times, circular texture formation of the metallurgical coke increased with increased volume. This signifies that, the metallurgical coke which produced from non-coking coal using the method of the present disclosure will have properties required for use in blast furnaces for smelting.

Figure 6:
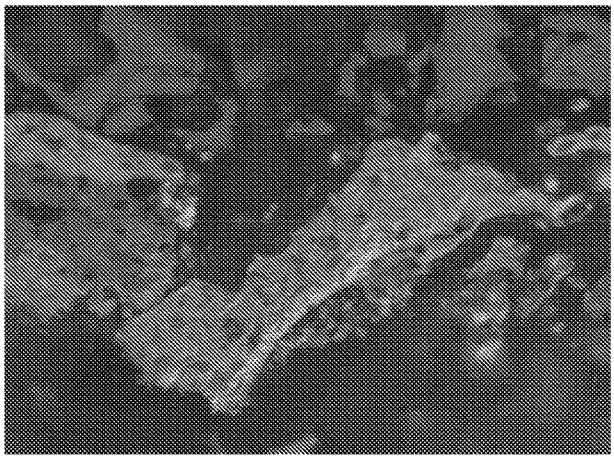
FIG. 6 illustrates microscopic image of a lenticular texture formation on the produced metallurgical coke, in accordance with an embodiment of the present disclosure.

FIG. 6 illustrates microscopic image of the lenticular texture (The binder phase carbons produced from medium volatile coals that contain vitrinoid V-Types 12, 13 and 14 are lenticular in shape having widths that range from 1.0 to 12.0 microns, with a length (L) to width (W) ratio of 2 to 4. Some systems refer to lenticular domains as leaflet. The fine, medium and coarse categories closely correspond to V-Types 12, 13 and 14) formation on the metallurgical coke. The circular texture formation is essential in gasification of coke inside the blast furnace and controls the reactivity and post-reaction strength of coke.

Figure 7:
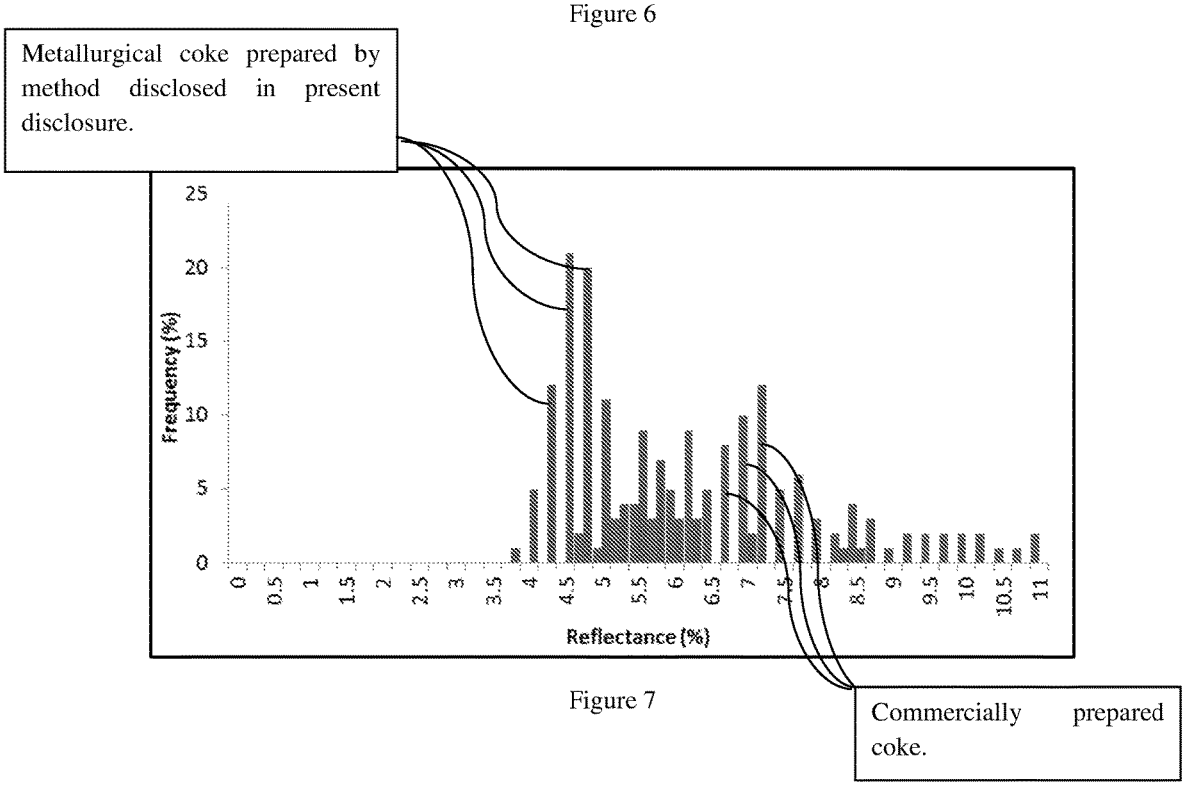
FIG. 7 illustrates a comparison graph in reflectance percentage between a commercially produced coke with the metallurgical coke produced in accordance with an embodiment of the present disclosure.

FIG. 7 illustrates a comparison graph in reflectance (measured through a polarized light microscope) percentage between a commercially produced coke with the metallurgical coke produced. From the graph, it is evident that the percentage reflectance of the metallurgical coke produced using the method of the present disclosure has a lower reflectance percentage and a higher frequency in comparison with the commercially produced coke.

EQUIVALENTS

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

REFERRAL NUMERALS

| Referral numerals | Description |
|---|---|
| 100 | Test System |
| MR | Microwave radiation |
| 1 | Microwave oven |
| 1a | Chamber |
| 2 | Microwave generator |
| 3 | At least one purging system |
| 4 | Plurality of firebricks |
| 4a | Cover firebrick |
| 4b | Base firebrick |
| 5 | At least one tuner device |
| 6 | Extractor unit |
| 7 | At least one waveguide |
| 8 | At least one inlet conduit |

-continued

| Referral numerals | Description |
|---|---|
| 9 | At least one outlet conduit |
| 10 | Control unit |
| 11 | Non-coking coal pellets |
| 12 | Grout |

The invention claimed is:

1. A method for producing metallurgical coke from only non-coking coal, the method comprising:

densifying the non-coking coal to form pellets (11);

placing the pellets (11) in a microwave oven (1) within a plurality of bricks (4);

heating the pellets (11) in the microwave oven (1) at a predetermined temperature under an inert atmosphere at atmospheric pressure, wherein the pellets (11) undergo pyrolysis during the heating; and cooling the pellets (11) in the microwave oven (1) under the inert atmosphere, to convert the pellets (11) of the non-coking coal to the metallurgical coke;

wherein heating of the pellets (11) in the microwave oven (1) is carried out without susceptors.

2. The method as claimed in claim 1, wherein densifying the non-coking coal, includes:

crushing the non-coking coal to form crushed non-coking coal; and compacting the crushed non-coking coal to form the pellets (11).

3. The method as claimed in claim 2, wherein the crushing of the non-coking coal is carried out in a hammer mill, or a pulveriser mill, wherein the crushed non-coking coal has 80% to 90% fineness.

4. The method as claimed in claim 2, wherein compacting of the crushed non-coking coal is carried out in a press, wherein the compacted density of the pellets (11) is in the range of 1100 kg/m$^3$ to 1150 kg/m$^3$.

5. The method as claimed in claim 3, wherein a binder is used in compacting of the crushed non-coking coal to form the pellets (11).

6. The method as claimed in claim 1, wherein the inert atmosphere is created by purging inert gas into the microwave oven (1).

7. The method as claimed in claim 6, wherein the inert gas is purged into the microwave oven (1) before heating of the pellets (11) and during heating of the pellets (11), at a flow rate ranging from 60 litres/minute to 90 litres/minute for a time period ranging from 3 minutes to 8 minutes.

8. The method as claimed in claim 1, wherein the pellets (11) are subjected to cooling in the microwave oven (1) under the inert atmosphere at a rate of 51/min to 201/min.

9. The method as claimed in claim 1, wherein the heating is carried out at a microwave power intensity in the range of 2 kW to 8 kW for a time period ranging from 10 minutes to 40 minutes.

10. The method as claimed in claim 1, wherein the predetermined temperature ranges from 900° C. to 1100° C., increasing at a rate of 40° C. to 60° C. per minute.

11. The method as claimed in claim 1, wherein density of the metallurgical coke produced by the method is in the range of 380 kg/m$^3$ to 440 kg/m$^3$.

12. A metallurgical coke formed from the method as claimed in claim 1.

* * * * *